United States Patent [19]

Alexander et al.

[11] 4,061,553

[45] Dec. 6, 1977

[54] ELECTROPLATING APPARATUS AND METHOD

[75] Inventors: Robert W. Alexander, Columbia; John G. Keck, Lexington, both of S.C.

[73] Assignee: Carolina Steel & Wire Corporation, Lexington, S.C.

[21] Appl. No.: 747,223

[22] Filed: Dec. 3, 1976

[51] Int. Cl.[2] ..... C25C 1/16; C25B 11/10; C25D 17/12

[52] U.S. Cl. ..... 204/114; 204/286; 204/297 R

[58] Field of Search ..... 204/297 R, 285–287, 204/114, 28

[56] References Cited

U.S. PATENT DOCUMENTS

| | | | |
|---|---|---|---|
| 2,708,181 | 5/1955 | Holmes et al. | 204/28 |
| 2,865,832 | 12/1958 | Pitzer | 204/285 X |
| 3,450,625 | 6/1969 | Ramsey et al. | 204/287 X |
| 3,729,389 | 4/1973 | De Angelo et al. | 204/297 R X |
| 3,954,571 | 5/1976 | Eppensteiner | 204/286 X |

*Primary Examiner*—T. Tung
*Assistant Examiner*—D. R. Valentine
*Attorney, Agent, or Firm*—Mason, Fenwick & Lawrence

[57] ABSTRACT

An electroplating process and apparatus employs a horizontally oriented zirconium plate supporting the entire weight of a plurality of zinc anode blocks in an electrolytic solution with a zirconium bus bar connected to the zirconium plate on one end but having an opposite end external of the electrolytic bath.

6 Claims, 2 Drawing Figures

ELECTROPLATING APPARATUS AND METHOD

Figure 1:
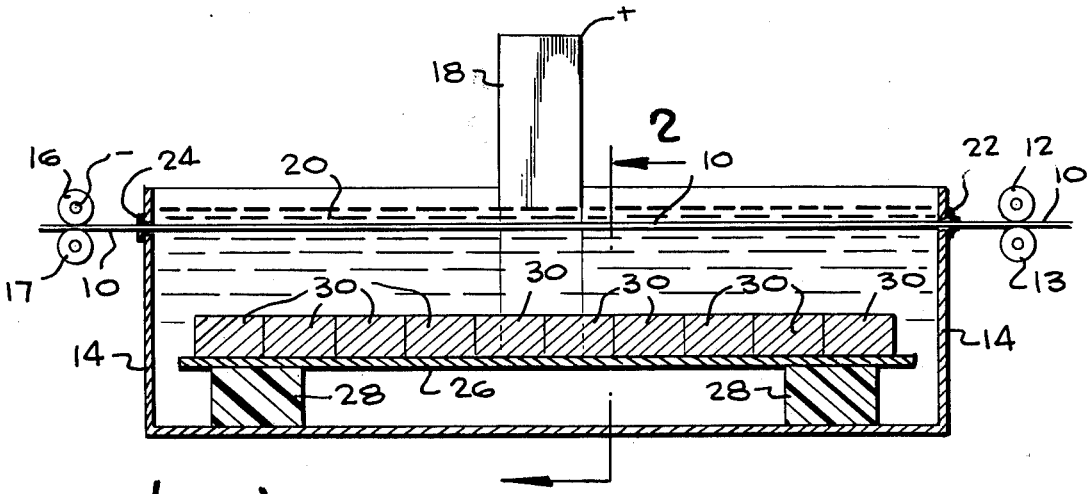

This invention is in the field of electroplating and is specifically directed to an apparatus and method for plating zinc on a substrate such as a steel strip or wire or other metal having the capacity to serve as a substrate. Even more particularly, the invention is directed to a unique plating apparatus emmploying anode support means having substantial cost and functional advantages over anode supports previously employed in electroplating.

Electroplating operations in which a movable substrate in the form of a wire or sheet is moved through the electroplating bath continuously for deposition of a thin coating through well-known electroplating techniques have been employed for many years. Generally speaking, the prior known systems have employed anodes such as zinc blocks positioned in the plating solution and supported for electrical contact with a source of voltage by a variety of anode support devices of varying material, size and shape. Obviously, it is desirable that the anode supports be immune to the chemical action effected by the operation of the plating system since any chemical reaction of the support would affect and possibly impair the plating operation by lowering the adhesion and coating effectiveness of the deposited coating on the substrate. Moreover, corrosion of the anode support will obviously require eventual replacement of the support. As a result of these facts, various materials have been suggested for use as anode supports in electroplating operations. For example, U.S. Pat. No. 3,954,571 discloses relatively small anode support formed essentially of a member selected from the group consisting of tantalum, niobium and mixtures thereof with the support providing structural support for one end of the anode bars and also providing the electrical contact with the anode and the positive terminal of an electrical source. Additionally, the patent discloses the employment of non-reactive polyvinyl chloride blocks for providing structural support of the ends of the anode bars not supported by the tantalum and niobium support portions within the plating tank. While plating systems of the foregoing type provide good functional results, the tantalum and niobium used in the anode support means is expensive and this fact is apparently the reason that the anode support made of these materials is relatively small and does not engage the entire under surface of the anode blocks. Moreover, the expensive nature of tantalum and niobium renders the system of the aforementioned patent economically impractical for many electroplating operations.

Other prior known electroplating systems have employed carbon plates for supporting the anodes and providing the electrical contact with the source of positive voltage. Such plates, while not of high initial cost, suffer from operational difficulties in that there is a relatively high contact resistance between the carbon and the anode components so as to increase the current requirements to consequently increase power consumption and lower the efficiency of the operation. Moreover, carbon anode support plates are subject to errosion to a certain extent so that they consequently require eventual replacement.

Therefore, it is the primary object of this invention to provide a new and improved apparatus and method of electroplating.

Yet another object of the invention is the provision of a new and improved method and apparatus for continuously electroplating a moving member.

Yet another object of the invention is the provision of a new and improved method and apparatus for electroplating that has improved plating efficiency, coating and adhesion effectiveness and is economical to use.

Achievement of the foregoing objects is provided by the preferred embodiment for practice of the invention in which an electroplating tank is provided with an anode support plate horizontally positioned in the tank. The support plate is formed of zirconium and is of sufficient size and strength to provide the entire mechanical support of a plurality of zinc anode bars immersed in the plating solution and resting on the upper surface of the zirconium anode support plate. The anode bars are totally supported by the zirconium plate so as to provide for a large and effective electrical contact surface consisting of the entire bottom surface of each anode block and the surface area of the zirconium plate on which the anode is supported; the zirconium anode support plate is itself supported in the plating tank by non-reactive pillar block members formed of polyvinyl chloride or other suitable material. The zirconium anode support provides low electrical resistance between the support and the anode blocks so as to achieve an effective and efficient electrical flow with the plating operation providing results of high quality equal to or better than that previously achieved by the known prior art devices. Moreover, the cost of the apparatus is substantially less than that of the system illustrated in U.S. Pat. No. 3,954,571 in that zirconium is substantially less expensive than either tantalum or niobium. In fact, it is economically practical to employ zirconium to provide the entire support for the anode and the support, a feature which would be economically impractical when using the more expensive materials employed for the anode support in the foregoing patent.

Figure 2:
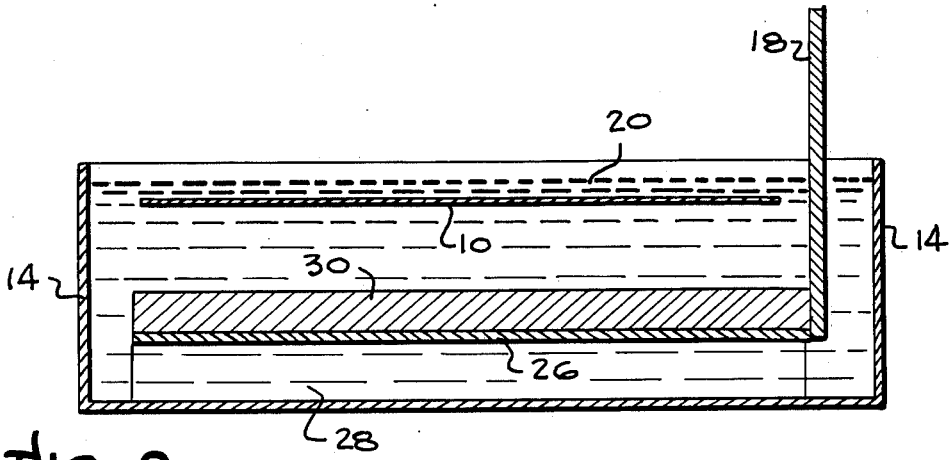

A better understanding of the manner in which this invention achieves the objects of the invention will be achieved when the following detailed description is considered in conjunction with the appended drawings in which:

FIG. 1 is a front sectional view of an electroplating tank illustrating the preferred embodiment for practice of the invention; and FIG. 2 is a side sectional view taken along lines 2—2 of FIG. 1.

Attention is invited to the drawings in which like reference characters refer to the same parts in the different figures with an on-the-fly plating operation being illustrated for applying a thin coating of zinc to a continuously moving substrate in the form of a steel sheet 10. It should be understood that the substrate is not limited to sheet members and that wires or other travelling substrate elements are used in practice of the invention with equal ease and effectiveness.

In any event, the travelling substrate 10 is supported at the entrance end of the tank by contact roller means 12 and backup roller means 13 and is supported on the downstream or exit side of tank 14 by means of contact roller means 16 and backup roller means 17. The roller 12 and 16 or other means are employed for connecting the trabelling substrate 10 with a source of negative direct current voltage with a vertically extending bus bar 18 formed of zirconium being connected to the positive terminal of the direct current source.

Tank 14 is provided with a quantity of plating solution 20 so that the travelling substrate 10 is completely immersed in the solution with the substrate passing into the tank through an upstream seal means 22 and exiting from the tank through a down-stream seal means 24 serving to retain the plating solution in the tank.

The lower end of the vertically extending zirconium bus bar 18 is welded or otherwise suitably connected to a horizontally extending anode support plate 26 which is also formed of zirconium; alternatively, the bus bar 18 and anode support plate 25 can be unitarily formed of one piece if desired. Zirconium anode support plate 26 is supported by a plurality of inert pillar blocks 28 formed of plastic, polyvinyl chloride or similar materials which will not be effected by the operation of the plating system.

A plurality of zinc anode blocks 30 rest on and are supported by the upper surface of the zirconium anode support plate 26 so that the entire bottom surface of each of the anode blocks 30 is in contact with a portion of the upper surface of the zirconium anode support plate to provide a large area for passage of current from the anode support plate 26 to the anode members 30. The foregoing fact provides for an effective and efficient flow of current between the support plate 26 and the anode members 30 without any reaction occurring between the support plate and the other components in tank 14.

While the preferred embodiment illustrates a zinc electroplating process, it should be understood that the plating solution 20 can be selected from many conventional zinc sulphate or zinc chloride plating bath mixtures. However, the system could by employed for plating other metals in which there would be no reaction of the zirconium anode support with the electrolyte or the anodes. Obviously, there are some types of plating in which the zirconium anode support would not be suitable due to the corrosive chemical reaction between the zirconium and the electrolyte employed in such operations.

Operation of the inventive system produces exceptional coating adhesion and minimizes the hydrogen embrittlement of high carbon steel wire. In fact, the system has been employed for the plating of wire for steel aircraft cable with the resultant cable for exceeding the endurance requirements of military specifications MIL-W-1511. Moreover, the plating adhesion and drawability have been exceptional in plating wire which is subsequently drawn from a diameter of 0.041 inches down to 0.007 inches diameter using high carbon steel wire with the resultant wire exceeding the coating requirements of the foregoing military specification. While the process yields excellent results with high carbon steel substrates, it works equally well with other steel compositions.

Another substantial advantage accruing from use of the zirconium anode support is that there is a protective oxide formation on the surface of the zirconium anode in contact with the plating solution which inhibits the passage of stray current through the metal to solution interface. Consequently, all of the current flow must pass efficiently through the zinc anode zirconium poate interface. Moreover, the use of zirconium provides a substantial economic advantage over tantalum and niobium in that tantalum is approximately four times as costly as zirconium while niobium is approximately three times as costly as zirconium. Furthermore the foregoing comparison is based on the price per pound; however, zirconium is of lower density than tantalum so that the volume of zirconium costs only one eighth the cost of the same volume of tantalum. Similarly, the density difference between zirconium and niobium renders the cost of a unit volume of zirconium equal to one fourth the same volume of niobium. Therefore, it will be appreciated that the subject invention provides unique economic and functional advantages over the prior systems.

The subject invention is not limited to use in plating a moving substrate and can be used in plating objects stationarily positioned in the tank. Along these lines, while other modifications of the preferred embodiment for practice of the subject apparatus and method of the invention will undoubtedly occur to those of skill in the art, it should be understood that the spirit and scope of the invention is to be limited solely by the appended claims.

We claim:

1. A zinc plating process for plating zinc on a metallic substrate comprising the steps of positioning the substrate in an electrolytic bath containing an ionized zinc salt, positioning an anode support means formed substantially of zirconium in the electrolytic bath, positioning zinc anode means on the anode support means and connecting a source of direct current across the anode support and the substrate to effect a plating operation onto the substrate.

2. The method of claim 1 wherein said zinc anode means is positioned on said anode support means so that said zinc anode means is entirely supported by said anode support means.

3. The method of claim 1 wherein the zinc salt is zinc sulphate and the substrate is a steel member.

4. The method of claim 3 wherein the connecting of the source of direct current across the anode support and the substrate includes the positioning of a zirconium bus bar having one end connected to the anode support in the electrolytic bath and an opposite end connected to the source of direct current externally of said electrolytic bath.

5. The method of claim 1 wherein the zinc salt is zinc chloride and the substrate is a steel member.

6. The method of claim 5 wherein the connecting of the source of direct current across the anode support and the substrate includes the positioning of a zirconium bus bar having one end connected to the anode support in the electrolytic bath and an opposite end connected to the source of direct current externally of said electrolytic bath.

* * * * *